US005850751A

United States Patent [19]

Kuo

[11] Patent Number: 5,850,751

[45] Date of Patent: Dec. 22, 1998

[54] ACTUATING MECHANISM FOR A COMBINATION LOCK

[76] Inventor: Lambert Kuo, No. 16, Lane 459, Sec. 1, An Ho Rd., Tainan, Taiwan

[21] Appl. No.: 28,278

[22] Filed: Feb. 24, 1998

[51] Int. Cl.[6] ..... E05B 37/02

[52] U.S. Cl. ..... 70/26; 70/28; 70/52

[58] Field of Search ..... 70/25–30, 38 B, 70/38 C, 39, 43, 52, 233

[56] References Cited

U.S. PATENT DOCUMENTS

| | | | |
|---|---|---|---|
| 839,795 | 12/1906 | Wilcox | 70/52 |
| 901,972 | 10/1908 | Kone | 70/28 |
| 970,856 | 9/1910 | Simisky | 70/29 |
| 1,146,443 | 7/1915 | Pellegrino | 70/43 |
| 1,773,204 | 8/1930 | Scheibner | 70/26 |
| 4,610,152 | 9/1986 | Düringer | 70/30 |
| 5,142,888 | 9/1992 | Ling | 70/26 |
| 5,406,811 | 4/1995 | Nakai | 70/28 X |
| 5,535,609 | 7/1996 | Kuo | 70/39 X |
| 5,787,736 | 8/1998 | Ling | 70/26 |
| 5,791,169 | 8/1998 | Kuo | 70/28 X |

*Primary Examiner*—Lloyd A. Gall
*Attorney, Agent, or Firm*—Kolisch Hartwell Dickinson McCormack & Heuser

[57] ABSTRACT

An actuating mechanism includes a receiving base defining a channel and having a first end portion and a second end portion formed with a cylinder defining a lock hole communicating with the channel, and a retaining post extending from the cylinder. A shackle includes a first end portion and a second end portion defining a lock cavity communicating with the lock hole. A locking member is slidably mounted in the channel and includes a first end portion and a second end portion formed with a locking hook detachably received in the lock cavity. A drive shaft extends through a rotary ring module and includes a first end portion and a second end portion fixedly engaged with the locking member such that the locking member can be moved with the drive shaft synchronously. A circular piece is slidably mounted on the retaining post and is formed with a side extension abutting on the second end portion of the drive shaft. A biasing member is mounted between the circular piece and a pressing member which can be adapted to urge the circular piece which can in turn move the drive shaft via the side extension.

6 Claims, 7 Drawing Sheets

ACTUATING MECHANISM FOR A COMBINATION LOCK

FIELD OF THE INVENTION

The present invention relates to an actuating mechanism, and more particularly to an actuating mechanism for a combination lock.

BACKGROUND OF THE INVENTION

A type of conventional combination lock for a bicycle comprises a cylindrical crossbar, a lock body received in the crossbar and including a plurality of rotary rings each having a plurality of numbers thereon, and a flexible wire cable detachably mounted on the lock body. By such an arrangement, however, the lock body is positioned in the crossbar by means of a thrust pin such that the security effect therebetween is not efficient. In addition, such a combination lock cannot be adapted to be suitable for an inverted U-shaped padlock.

The present invention has arisen to mitigate and/or obviate the disadvantage of the conventional combination lock.

SUMMARY OF THE INVENTION

In accordance with one aspect of the present invention, there is provided an actuating mechanism in combination with a lock comprising a semi-cylindrical receiving base defining a channel and including a first end portion and a second end portion formed with a cylinder radially defining a lock hole communicating with the channel, and a retaining post extending from the cylinder.

A shackle includes a first end portion and a second end portion slidably received in the lock hole and defining a lock cavity communicating with the lock hole. A locking member is slidably mounted in the channel and includes a first end portion and a second end portion formed with a locking hook detachably received in the lock cavity.

A rotary ring module is fixedly mounted in the channel and is located adjacent to the first end portion of the locking member. A drive shaft slidably extends through the rotary ring module and includes a first end portion and a second end portion fixedly engaged with the locking member such that the locking member can be moved with the drive shaft synchronously.

A circular piece is slidably mounted on the retaining post and is formed with a side extension abutting on the second end portion of the drive shaft. A biasing member includes a first end portion urged on the circular piece and a second end portion. A pressing member is urged on the second end portion of the biasing member.

Further features of the present invention will become apparent after a careful reading of the detailed description with reference to the accompanying drawings.

DETAILED DESCRIPTION OF THE PREFERRED EMBODIMENTS

Figure 1:
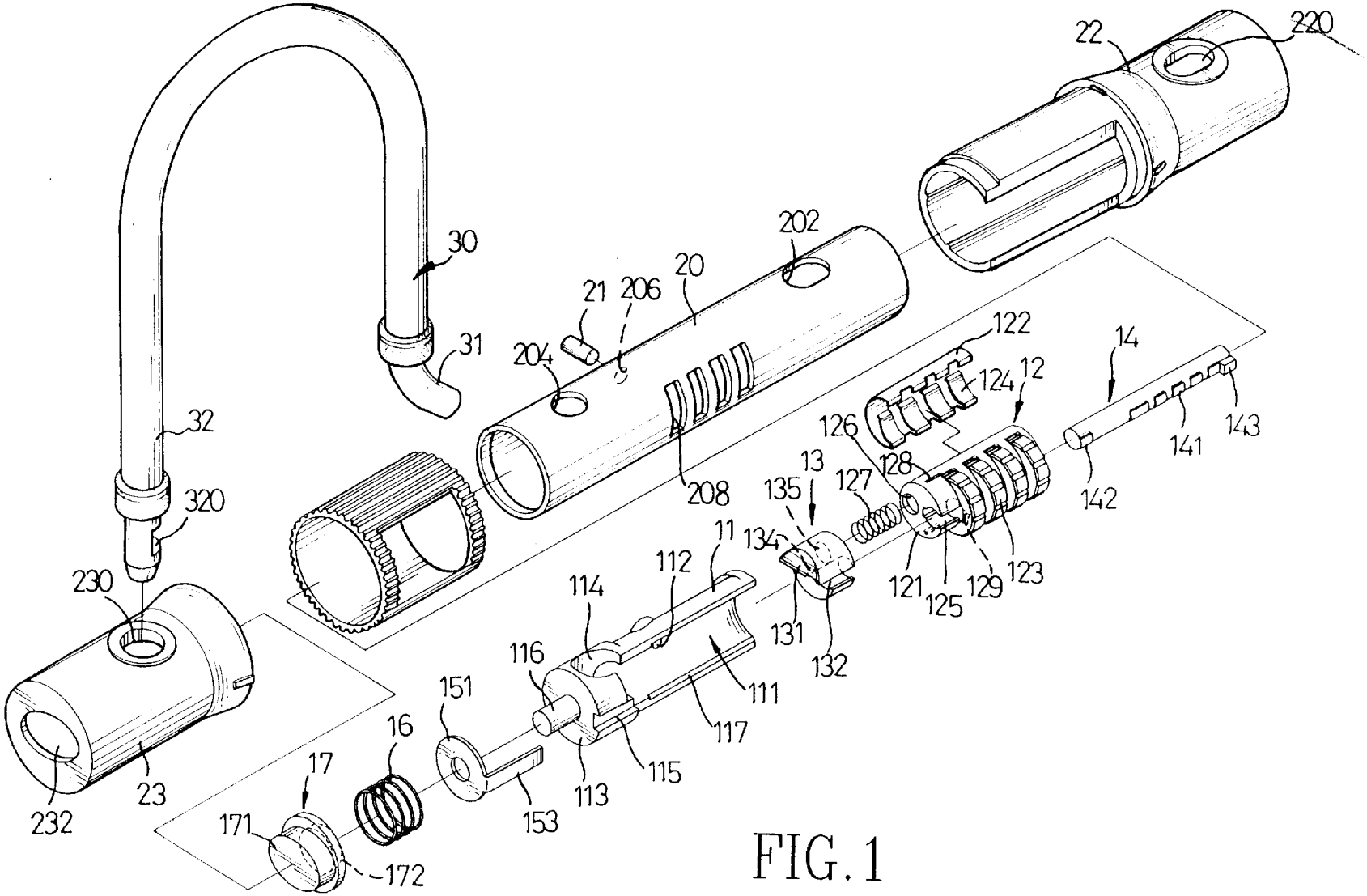
FIG. 1 an exploded view of a combination lock in accordance with a first embodiment of the present invention.
Figure 2:
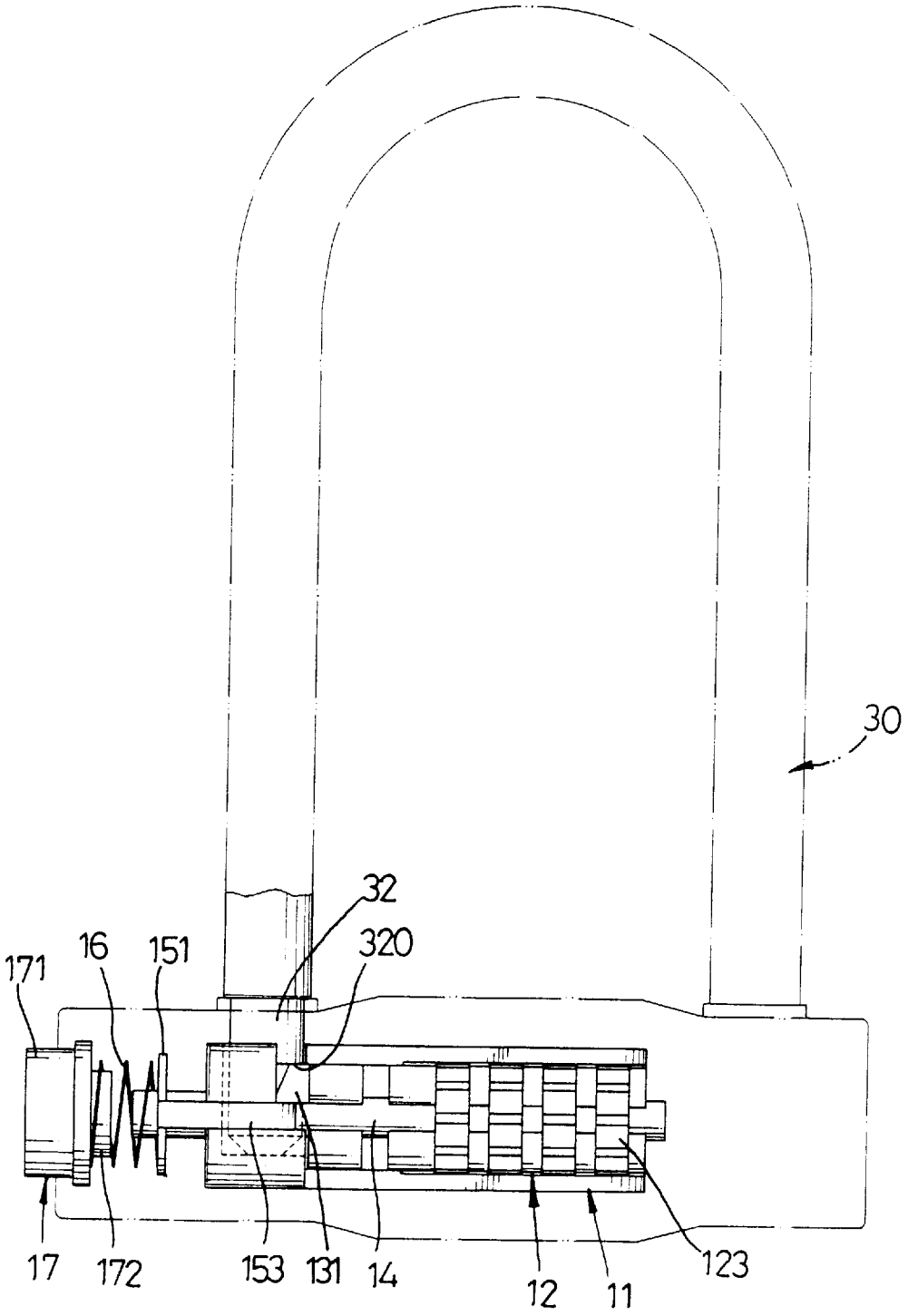
FIG. 2 is a front plan schematic assembly view of the combination lock shown in FIG. 1.
Figure 3:
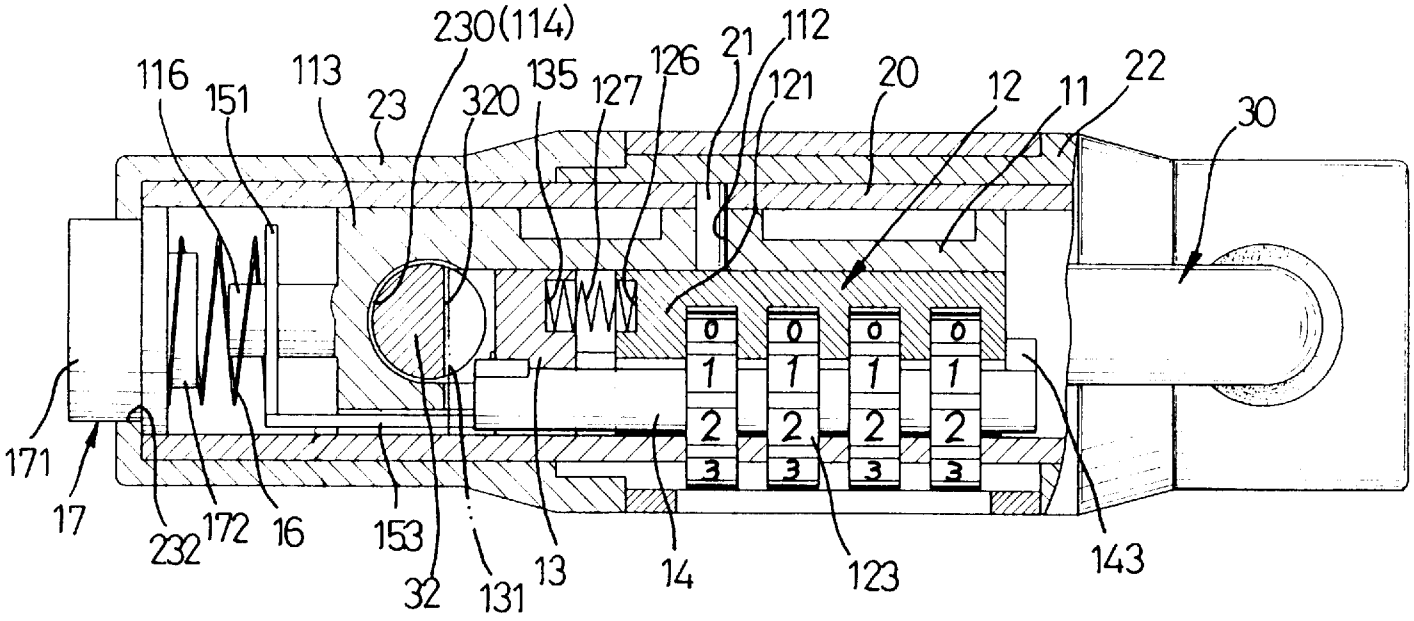
FIG. 3 is a top plan partially cross-sectional assembly view of the combination lock shown in FIG. 1.
Figure 7:
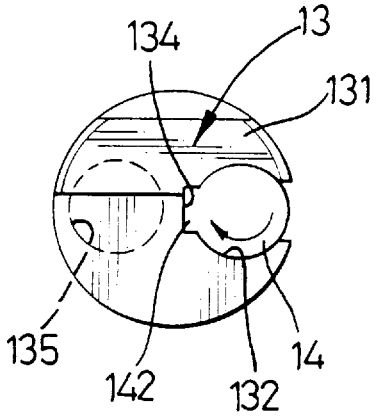
FIG. 7 is a side view showing an engagement between a locking member and a drive shaft.

Referring to the drawings, and initially to FIGS. 1–3 with reference to FIG. 7, a combination lock according to a first embodiment of the present invention can be adapted for a bicycle and comprises an actuating mechanism comprising a semi-cylindrical receiving base 11 fixedly mounted in an inner tube 20. A positioning pin 21 extends through a first bore 206 defined in the inner tube 20 and a second bore 112 defined in the receiving base 11, thereby securing the receiving base 11 in the inner tube 20.

The receiving base 11 includes an inner wall defining a channel 111 and includes a first end portion and a second end portion formed with a cylinder 113 radially defining a lock hole 114 communicating with the channel 111, and a retaining post 116 extending from the cylinder 113.

A shackle 30 includes a first end portion 31 and a second end portion 32 slidably received in the lock hole 114 and defining a lock cavity 320 communicating with the lock hole 114.

The inner tube 20 includes a first end portion defining a first inner hole 202 receiving the first end portion 31 of the shackle 30 and a second end portion defining a second inner hole 204 aligning with the lock hole 114 for receiving the second end portion 32 of the shackle 30.

A first outer column 22 is fixedly mounted on the first end portion of the inner tube 20 and defines a first outer hole 220 aligning with the first inner hole 202 for receiving the first end portion 31 of the shackle 30.

A second outer column 23 includes a first end portion fixedly mounted on the second end portion of the inner tube 20 and defining a second outer hole 230 aligning with the second inner hole 204 for receiving the second end portion 32 of the shackle 30, and a second end portion defining a socket 232.

A locking member 13 is slidably mounted in the channel 111 and includes a first end portion and a second end portion formed with a locking hook 131 detachably received in the lock cavity 320.

A rotary ring module 12 located adjacent to the first end portion of the locking member 13 is fixedly mounted in the channel 111. The inner wall of the receiving base 11 is formed with two radially opposite abutting flanges 117, and the rotary ring module 12 includes a circular block 121 formed with two radially opposite stops 128 each abutting on a corresponding one of the two abutting flanges 117.

A drive shaft 14 slidably extends through a first passage 125 defined in the rotary ring module 12 and a second passage 132 defined in the locking member 13 and includes a first end portion formed with a limiting boss 143 and a second end portion formed with a positioning boss 142 which can be rotated through one hundred and eighty degrees so as to be received in a depression 134 as shown in FIG. 7, thereby securing the second end portion of the drive shaft 14 to the locking member 13 such that the locking member 13 can be moved with the drive shaft 14 synchronously.

A circular piece 151 is slidably mounted on the retaining post 116 and is formed with a side extension 153 extending through a recess 115 defined in the cylinder 113 and abutting on the second end portion of the drive shaft 14.

A pressing member 17 is slidably mounted in the inner tube 20 and is formed with a knob 171 extending through the socket 232. A first biasing member 16 is urged between the pressing member 17 and the circular piece 151 and includes a first end portion mounted around the retaining post 116 and a second end portion mounted around a stub 172 formed on the pressing member 17.

The inner tube 20 includes a sidewall defining a plurality of slots 208. The rotary ring module 12 includes a plurality of rotary rings 123 each rotatably extending through a corresponding one of the slots 208 and each including an inner wall defining a spline 129. The drive shaft 14 extends through each of the rotary rings 123 and includes an outer wall formed with a plurality of keys 141 each of which can pass through the spline 129 of each of the rotary rings 123 when the spline 129 is rotated by the rotary ring 123 to align with the key 141.

Each of the rotary rings 123 can be marked with a plurality of numbers as shown in FIG. 3, and a pawl member 122 is secured on the rotary ring module 12 and includes a plurality of teeth 124 each detachably engaged with a corresponding one of the plurality of rotary rings 123 such that each of the rotary rings 123 can rotate along one direction only.

The first end portion of the locking member 13 defines a first space 135, the circular block 121 of the rotary ring module 12 defines a second space 126, and a second biasing member 127 is urged between the first end portion of the locking member 13 and the circular block 121 and includes a first end portion received in the first space 135 and a second end portion received in the second space 126.

Figure 4:
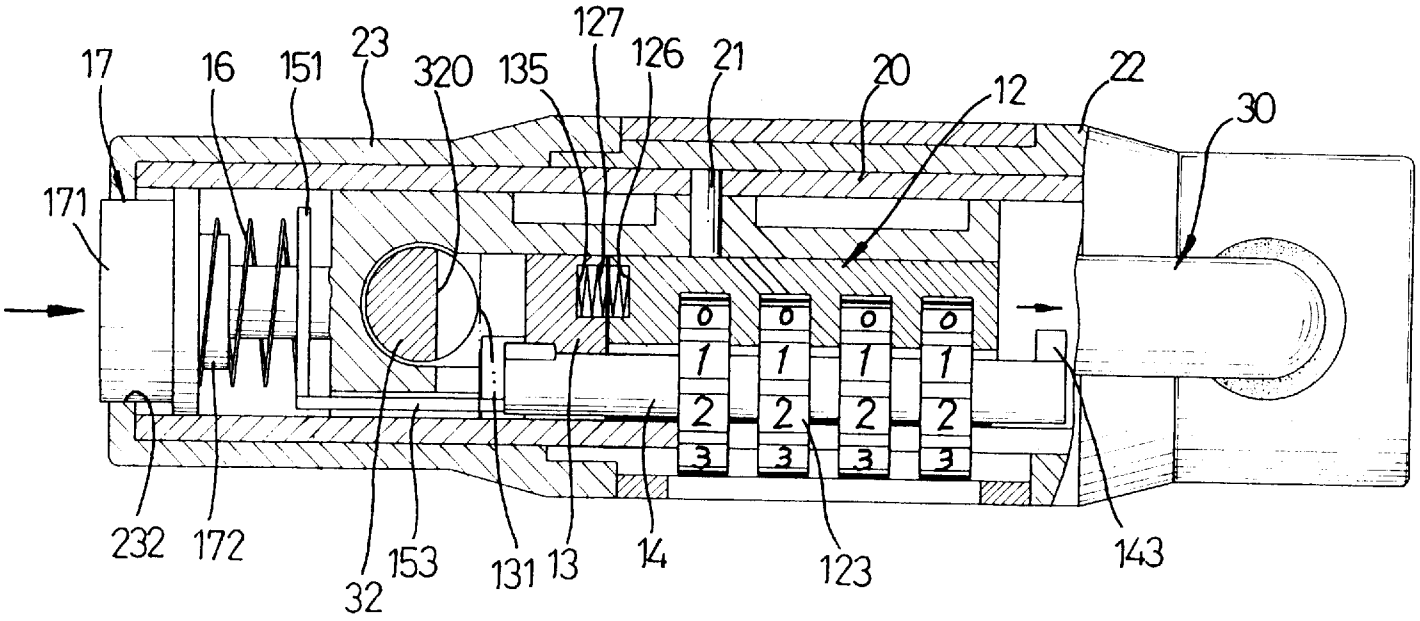
FIGS. 4 and 5 are operational views of FIG. 3.

In operation, referring to FIGS. 3 and 4 with reference to FIGS. 1 and 2, each of the keys 141 of the drive shaft 14 is initially retained by each of the rotary rings 123 such that the drive shaft 14 is fixed in the rotary ring module 12.

Each of the rotary rings 123 can then be rotated in the rotary ring module 12 to a position where the spline 129 of each of the rotary rings 123 aligns with each of the keys 141 of the drive shaft 14 such that the drive shaft 14 can be moved in the rotary ring module 12.

The knob 171 can then be pressed inwardly by a user to move the circular piece 151 via the first biasing member 16 so as to move the side extension 153 which can in turn move the second end portion of the drive shaft 14, so as to move the locking hook 131 of the locking member 13 from a first position as shown in FIG. 3 to a second position as shown in FIG. 4, thereby detaching the locking hook 131 from the lock cavity 320 such that the second end portion 32 of the shackle 30 can be released from the locking hook 131 of the locking member 13, thereby detaching the shackle 30 from the combination lock.

Figure 5:
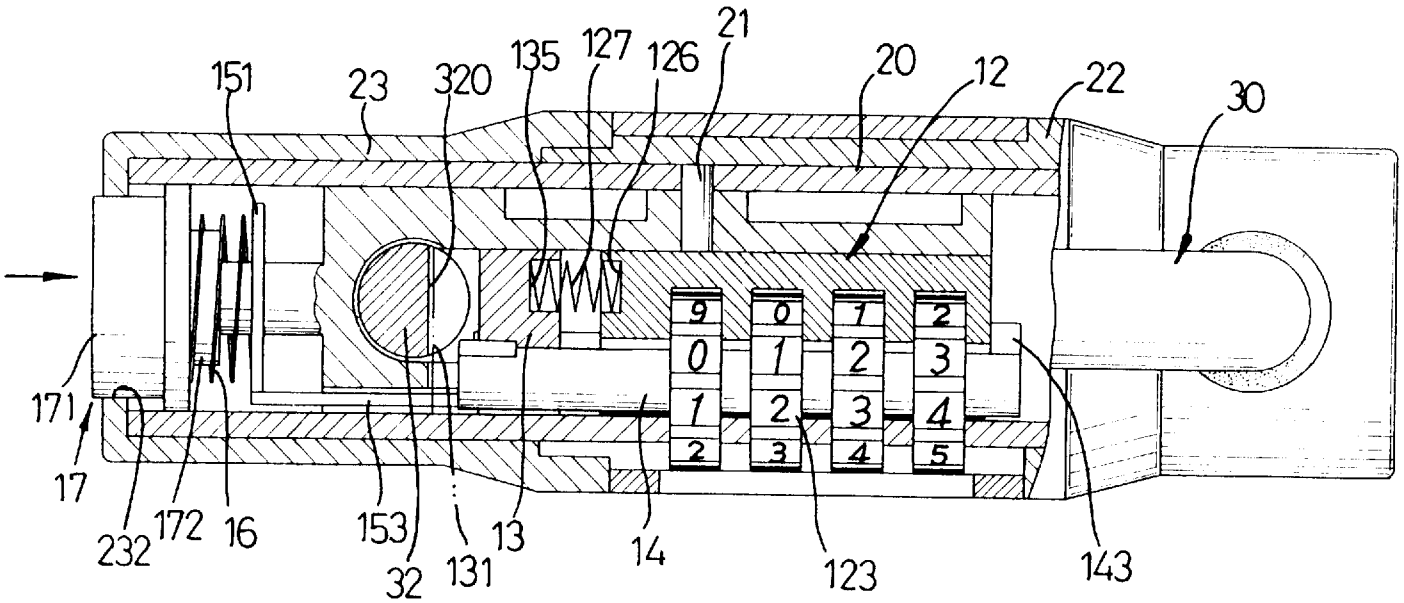

Alternatively, referring to FIGS. 3 and 5, some of the rotary rings 123 can be rotated in the rotary ring module 12 to from a first position as shown in FIG. 3 to a second position as shown in FIG. 5 where the spline 129 of at least one of the rotary rings 123 does not align with each of the keys 141 of the drive shaft 14 such that the keys 141 can be retained by the rotary rings 123, thereby fixing the drive shaft 14 in the rotary ring module 12.

In such a situation, even when a user exerts a pressing force on the knob 171, the drive shaft 14 cannot be moved by the side extension 153 because the drive shaft 14 is secured by the rotary ring module 12 such that the locking hook 131 of the locking member 13 can still be retained in the lock cavity 320, thereby securing the shackle 30.

Figure 6:
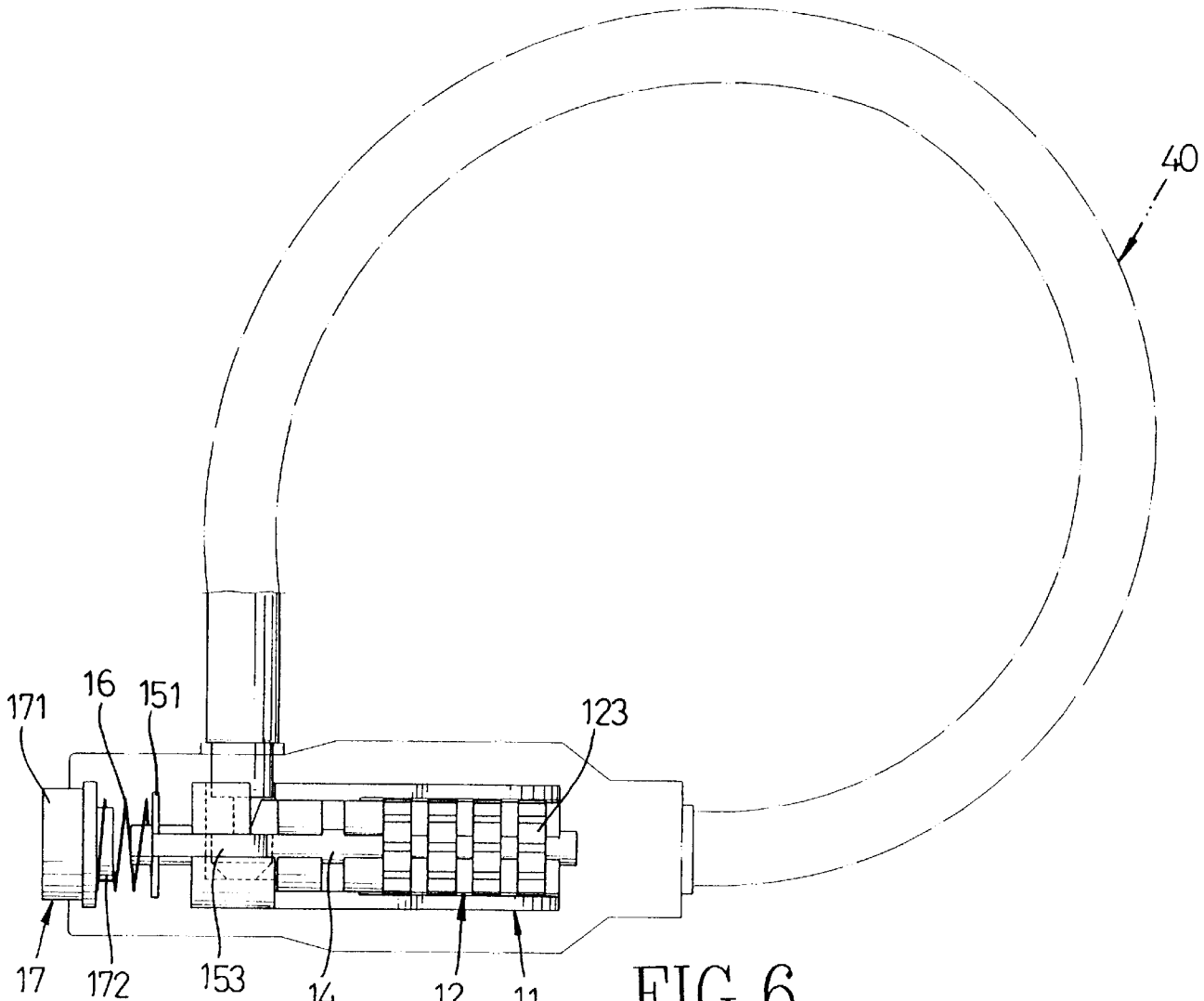
FIG. 6 is a front plan schematic assembly view of a combination lock in accordance with a second embodiment of the present invention.

Referring now to FIG. 6, in accordance with a second embodiment of the present invention, the combination lock can be adapted to suit a loop-shaped shackle 40.

It should be clear to those skilled in the art that further embodiments of the present invention may be made without departing from the scope and spirit of the present invention.

What is claimed is:

1. An actuating mechanism in combination with a lock comprising:

a semi-cylindrical receiving base (11) defining a channel (111) and including a first end portion and a second end portion formed with a cylinder (113) radially defining a lock hole (114) communicating with said channel (111), and a retaining post (116) extending from said cylinder (113);

a shackle (30) including a first end portion (31) and a second end portion (32) slidably received in said lock hole (114) and defining a lock cavity (320) communicating with said lock hole (114);

a locking member (13) slidably mounted in said channel (111) and including a first end portion and a second end portion formed with a locking hook (131) detachably received in said lock cavity (320);

a rotary ring module (12) fixedly mounted in said channel (111) and located adjacent to said first end portion of said locking member (13);

a drive shaft (14) slidably extending through said rotary ring module (12) and including a first end portion and a second end portion fixedly engaged with said locking member (13) such that said locking member (13) can be moved with said drive shaft (14) synchronously;

a circular piece (151) slidably mounted on said retaining post (116) and formed with a side extension (153) abutting on said second end portion of said drive shaft (14);

a biasing member (16) including a first end portion urged on said circular piece (151) and a second end portion; and a pressing member (17) urged on said second end portion of said biasing member (16).

2. The actuating mechanism in combination with the lock according to claim 1, wherein said pressing member (17) is formed with a knob (171), and said combination further comprises:

an inner tube (20) in which said receiving base (11) is fixedly received including a first end portion defining a first inner hole (202) receiving said first end portion (31) of said shackle (30) and a second end portion defining a second inner hole (204) aligning with said lock hole (114) for receiving said second end portion (32) of said shackle (30);

a first outer column (22) fixedly mounted on said first end portion of said inner tube (20) and defining a first outer hole (220) aligning with said first inner hole (202) for receiving said first end portion of said shackle (30); and a second outer column (23) including a first end portion fixedly mounted on said second end portion of said inner tube (20) and defining a second outer hole (230) aligning with said second inner hole (204) for receiving said second end portion (32) of said shackle (30), and a second end portion defining a socket (232) receiving said knob (171) of said pressing member (17).

3. The actuating mechanism in combination with the lock according to claim 2, wherein said inner tube (20) includes an outer periphery defining a plurality of slots (208), said rotary ring module (12) includes a plurality of rotary rings (123) each rotatably extending through a corresponding one of said slots (208) and each including an inner wall defining a spline (129), and said drive shaft (14) extends through each of said rotary rings (123) and includes an outer wall formed with a plurality of keys (141) each of which can pass through said spline (129) of each of said rotary rings (123) when said spline (129) is rotated by said rotary ring (123) to align with said key (141).

4. The actuating mechanism in combination with the lock according to claim 1, wherein said cylinder (113) of said receiving base (11) defines a recess (115) receiving said side extension (153) of said circular piece (151).

5. The actuating mechanism in combination with the lock according to claim 1, wherein said first end portion of said locking member (13) defines a first space (135), said rotary ring module (12) includes a circular block (121) defining a second space (126), and said combination further comprises a second biasing member (127) urged between said first end portion of said locking member (13) and said circular block (121) and including a first end portion received in said first space (135) and a second end portion received in said second space (126).

6. The actuating mechanism in combination with the lock according to claim 1, wherein said second end portion of said locking member (13) defines a depression (134), and said second end portion of said drive shaft (14) is formed with a positioning boss (142) received in said depression (134).

* * * * *